US006487732B1

(12) United States Patent
Smith

(10) Patent No.: US 6,487,732 B1
(45) Date of Patent: Dec. 3, 2002

(54) BIDET DEVICE

(76) Inventor: Warren Smith, 895 Adams Blvd., Boulder City, NV (US) 89005

( * ) Notice: Subject to any disclaimer, the term of this patent is extended or adjusted under 35 U.S.C. 154(b) by 0 days.

(21) Appl. No.: 10/066,888

(22) Filed: Feb. 4, 2002

(51) Int. Cl.[7] ..... A47K 3/20
(52) U.S. Cl. ..... 4/420.4
(58) Field of Search ..... 4/420.1–420.5, 4/443–448

(56) References Cited

U.S. PATENT DOCUMENTS 4,597,111 A * 7/1986 Hirashiba et al. ..... 4/420.4
4,953,238 A * 9/1990 Shifferly ..... 4/420.2
5,566,402 A * 10/1996 Agha el Rifai et al. ..... 4/420.4
5,572,748 A * 11/1996 Nee ..... 4/420.2
5,933,881 A * 8/1999 Smith ..... 4/420.4

* cited by examiner

*Primary Examiner*—Charles R. Eloshway
(74) *Attorney, Agent, or Firm*—Philip J. Anderson; Anderson & Morishita, LLC

(57) ABSTRACT

An improved bidet device is set forth which includes a rotatable handle and capstan for positioning a spray tube and for opening the supply of water to the tube for spraying. A screw is received by the capstan to mount the handle and is further provided with a radial port. An actuator is coupled to the screw for rotation of the screw relative to the capstan to modulate the flow of water through the device. The actuator may be ergonometrically designed.

3 Claims, 9 Drawing Sheets

BIDET DEVICE

FIELD OF THE INVENTION

The present invention relates to bidet devices of the type which are added to an existing toilet.

BACKGROUND

Bidet devices are known as described in my prior U.S. Pat. No. 5,933,881 the disclosure of which is hereby incorporated by reference. This device of my prior patent provides a structure for attachment thereof to an existing toilet (water closet) and which supports a valve structure for (1) positioning the spray tube and for turning on the supply of water. The flow and pressure of water through the spray tube and the spray holes thereof are dependent upon the water line pressure at the toilet, less any friction losses through fittings and the spray holes. Thus, if the line pressure is relatively constant, the flow and pressure and hence velocity of the water emitted from the spray tube holes will remain relatively constant as well. For the user to decrease the flow/pressure/velocity of the water or to turn it off completely to prevent, for example, a child from playing with the device, the user would have to turn off the supply of water to the device and toilet at, for example, an on/off valve at the wall behind the toilet.

There is a need for an improvement which provides for a simple, economical means to control flow/pressure/velocity of the water emitted by the device and to turn off the flow. Since the device may be operated by handicapped individuals, there is also a need for a flow control device which is position for easy, one hand control. There is further a need for the flow control to be ergonomically incorporated into the bidet device.

SUMMARY OF THE INVENTION

There is, therefore, provided according to the present invention an improved bidet device which provides for modulating the flow rate and pressure of the liquid flowing though the spray tube when the spray is activated. The improved bidet includes the handle coupled to a hollow capstan rotatable with the handle. The capstan has at one end a first hole adapted to communicate with a supply of water and at the other end a second radial hole adapted to communicate with the tube. At the second end the capstan further has internal threads. A screw having a hollow shank with external threads is configured to be threadably received into and close said capstan second end and to couple a handle to the capstan for rotation of the capstan with the handle to position the tube and open and close the supply of water through the capstan and tube. The screw shank further includes a radial port to rotatably register with the capstan second hole. An actuator is coupled to the screw to rotate the screw relative to the handle to position the port between a closed position where the port is positioned to not register with the second opening to prevent the flow of water to a full open position where port is fully registered with the second hole for full flow of water through the tube to modulate the flow and pressure of water though the tube and spray holes of the tube.

Thus the user can set the actuator to moderate the pressure and flow of water through the tube and spray holes of r the comfort of the user. One the actuator is position, the user need only move the handle to open the supply of water through the capstan and tube at the flow/pressure set by the actuator. Further the actuator can be set to close the supply of water to prevent inadvertent actuation of the bidet as by, for example, children.

In a further embodiment, the actuator may be ergonometrically shaped having a tear drop-shaped plan to define an arcuate surface to mate with the thumb for actuation of the actuator apart from actuation of the handle.

DESCRIPTION

1. The Existing, Prior Device

Figures 1, 2:
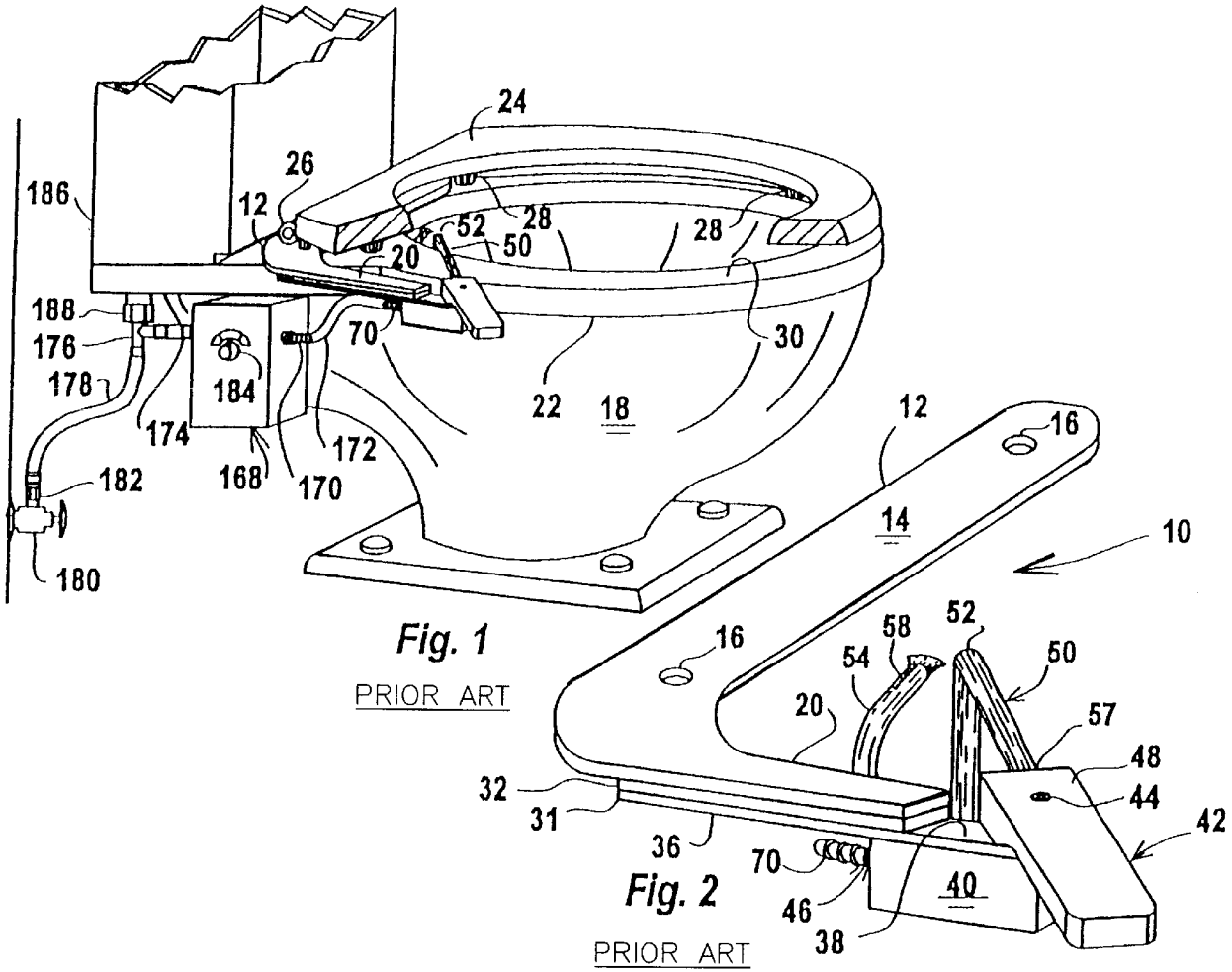
Fig. 1 PRIOR ART
Fig. 2 PRIOR ART
FIG. 1 is a perspective view, with a part broken away, of a portion of a prior art apparatus.
FIG. 2 is a perspective view of apparatus of FIG. 1.

As shown in FIGS. 1–4, a cleansing apparatus 10 (FIG. 2) includes an L shaped toilet mounting frame 12 that is preferably made from plastic. The frame 12 has a long side 14 with a pair of mounting holes 16 that have a spacing there between that is substantially equal to the spacing between mounting holes of a toilet seat. The spacing between the toilet seat mounting holes is standardized in the United States.

The long side 14 is positioned upon the rear of the exterior of a toilet bowl 18 (FIG. 1) of a toilet, with the holes 16 aligned with corresponding holes (not shown) of the bowl 18. A short side 20 of the frame 12 extends on the exterior of the bowl 18 along an outer edge 22 thereof.

A toilet seat 24 includes a hinged section 26 where the toilet seat mounting holes are located. Mounting bolts (not shown) pass through the holes of the bowl 18, the holes 16 and the toilet seat mounting holes whereby the long side 14 is sandwiched between the rear of the exterior of the bowl 18 and the hinged section 26. The bolts are screwed into nuts (not shown).

A plurality of standoffs 28 are connected to the bottom of the seat 24 in any suitable manner. The standoffs 28 create a space between the seat 24 and a rim 30 of the bowl 18 that is used in a manner described hereinafter. The use of a standoff to create a space between a toilet seat and a toilet bowl is well known in the art and is commonly provided on standard toilet seats.

A plastic spacer strip 32 (FIG. 2) is cemented between the short side 20 and a plastic component strip 34. The strip 34 has a surface 36 whereon a plastic valve block 40 is carried. A plastic handle 42 is carried on a surface 38 of the strip 34. The handle 42 is rotatable upon the surface 38 about a screw 44. The valve block 40 is connected to a hose bib 46.

A proximal end 51 of a plastic water tube 50 extends from an end 48 of the handle 42. More particularly, the tube 50 extends horizontally from the end 48. Because of the strip 32, the tube 54 passes beneath the seat 24, over the rim 30 (FIG. 1) to the interior of the bowl 18 via the space created by the spacers 28.

The tube 50 has a first right angle bend 52 (FIGS. 1–3) that causes a distal portion 54 (FIG. 3) of the tube 50 to extend below the rim 30. The tube 50 additionally has a second right angle bend 56 that causes the distal portion 54 to extend over water within the bowl 18. The distal portion 54 has a plurality of longitudinally aligned holes 58 therein (FIGS. 1–4).

In response to water being provided to the proximal end 51, a sheet of water is discharged from the holes 58. The orientation of the holes 58 causes the sheet of water to be directed toward the underside of the torso of a person seated upon the seat 24.

The sheet of water has been found to cause less splashing and provide superior cleansing than a fountain of water typically produced by devices of the prior art. Additionally, a wide coverage provided by the sheet of water obviates both the lateral movement of the person and a precise targeting of the water.

Figure 4:
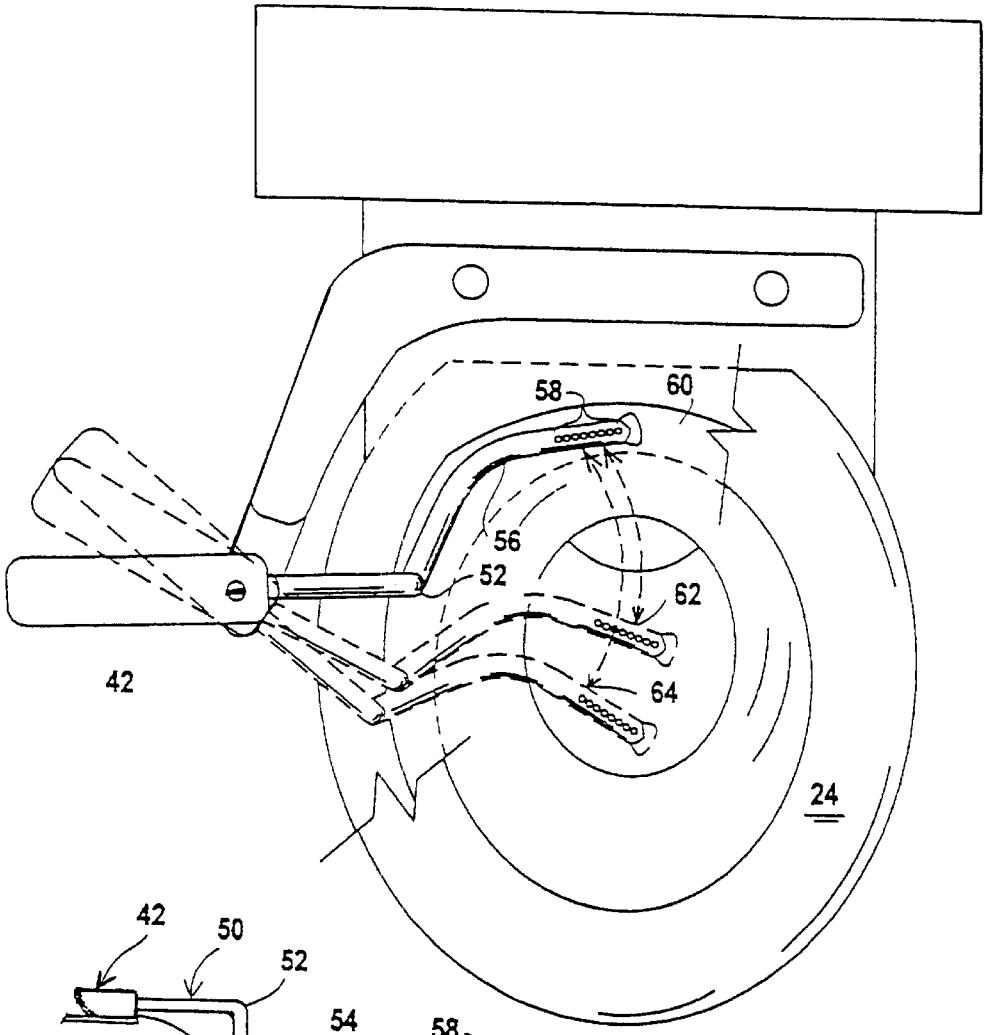
Fig. 4 PRIOR ART
FIG. 4 is a plan view, with a part broken away, of the apparatus of FIG. 1.
Figure 3:
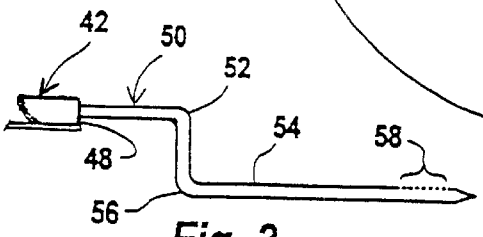
Fig. 3 PRIOR ART
FIG. 3 is a side elevation of a water tube in FIG. 1.

The tube 50 is at a withdrawn location when the distal portion 54 is withdrawn to a rear portion 60 of the bowl 18 (FIG. 4). When the tube 50 is withdrawn, the toilet can be used for the usual toilet facility activities without the tube 50 be subjected either to droppings of fecal matter or urine. For reasons explained hereinafter, water is not discharged from the holes 58 when the tube 50 is withdrawn. When the tube 50 is not withdrawn, water that flows into the hose bib 46, passes through the valve block 40 and the handle 42 to the tube 50. The water is discharged from the holes 58.

When, for example, the handle 42 is rotated to cause the distal portion 54 to pivot to a location 62, the tube 50 is in an anal cleansing position, whereby the sheet of water cleanses the anus of a woman seated upon the seat 24. When the handle 42 is rotated to cause the distal portion 54 to pivot to a location 64, the tube 50 is in a vaginal cleansing position whereby the sheet of water cleanses the woman's vagina. It should be understood that the handle 42 is rotatable to cause the distal portion 54 to be at any location that is intermediate to the locations 62, 64 whereby the sheet of water is moved to cleanse the woman's perineal skin area.

Figure 5:
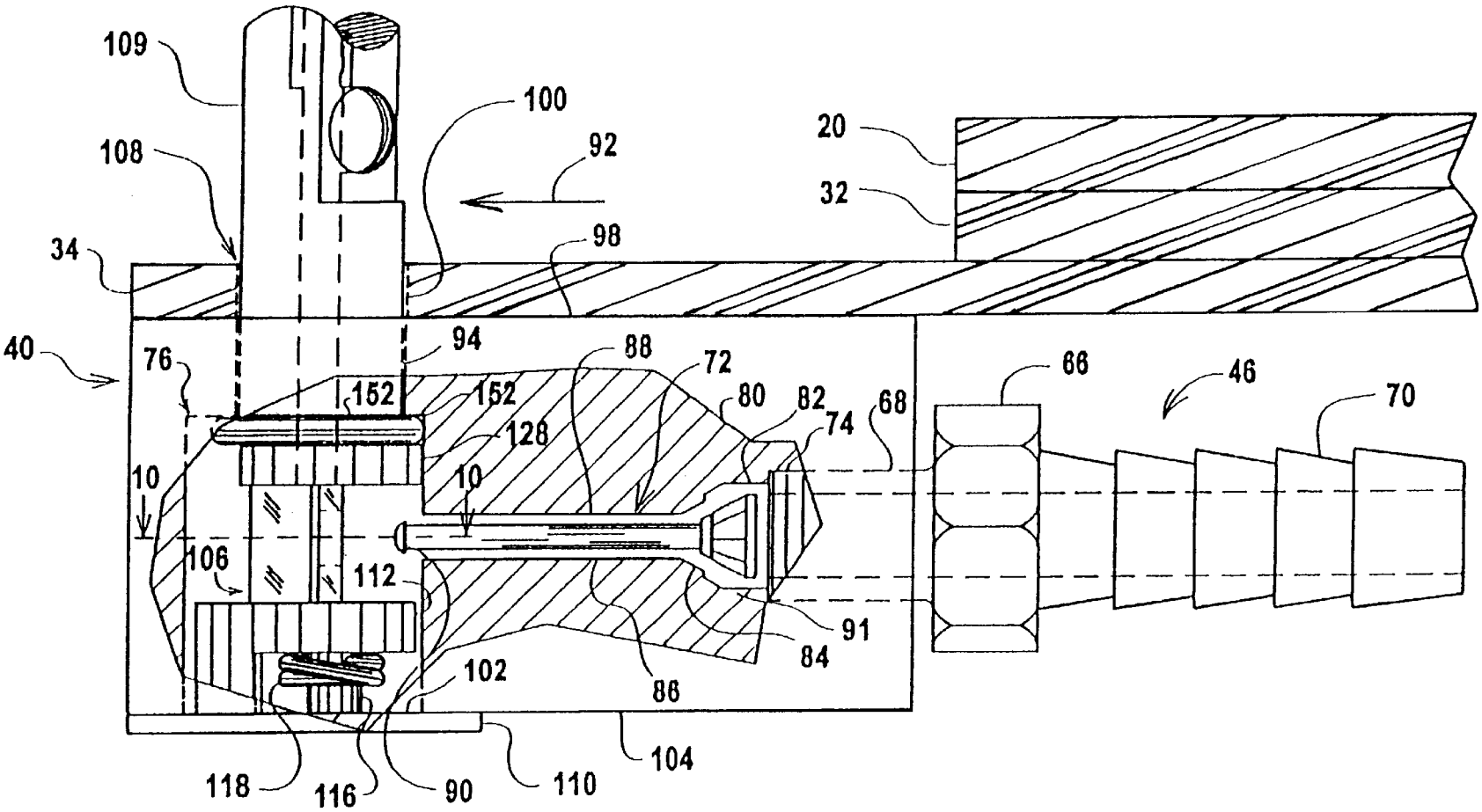
Fig 5 PRIOR ART
FIG. 5 is a side elevation, with parts broken away, of a valve block and a hose bib of FIG. 1.

As shown in FIG. 5, the hose bib 46 has a mid-section 66 in the shape of a hexagonal bolt head. The hose bib 46 additionally has a threaded end 68 and a scalloped end 70. As explained hereinafter, the end 68 is screwed into the valve block 40. Hose bibs are well known to those skilled in the art.

A passageway 72 within the valve block 40 extends from a widened threaded section 74 thereof to a valve chamber 76. The end 68 screws into the threaded section 74. A wrench (not shown) may be used to turn the mid-section 66 to screw the end 68 into the threaded section 74.

The passageway 72 includes a coupling section 80 that has the general shape of a funnel. A wide end 82 of the coupling section 80 is connected to the threaded section 74. A narrow end 84 of the coupling section 80 is connected to one end of a narrowed cylindrical section 86 of the passageway 72; the other end is contiguous with an opening in the valve chamber 76. Accordingly, there is a path for water that extends from the hose bib 46 to the valve chamber 76.

A valve stem 88 is disposed mostly within the passageway 72. The valve stem 88 has a rounded end 90. The end 90 extends into the interior of the valve chamber 76.

The valve stem 88 additionally has an end 91 that has the shape of a right truncated cone. The end 91 is disposed within the coupling section 80.

The pressure of water provided via the hose bib 46 urges the valve stem 88 to move in the direction of an arrow 92. Because of its conical shape, the end 91 occludes the passageway 72 to prevent a flow of water to the valve chamber 76. As explained hereinafter, the passageway 72 is cleared when the handle 42 is rotated to cause the tube 50 to move from the rest position.

A hole 94 extends from the valve chamber 76 to a top surface 98 of the valve block 40. The hole 94 is coaxial with a hole 100 through the strip 34. The holes 94, 100 have substantially the same diameter.

A hole 102 extends from the valve chamber 76 through a bottom surface 104 of the valve block 40. A plastic valve chamber insert 106 is inserted through the hole 102 into the valve chamber 76. The insert 106 includes a transfer tube 108 that has a section 109 that protrudes through the hole 100. The transfer tube 108 has a generally cylindrical shape. After the insertion, the hole 102 is sealed by a plastic sheet 110 that is cemented to a bottom surface 104 of the valve block 40.

Figure 6:
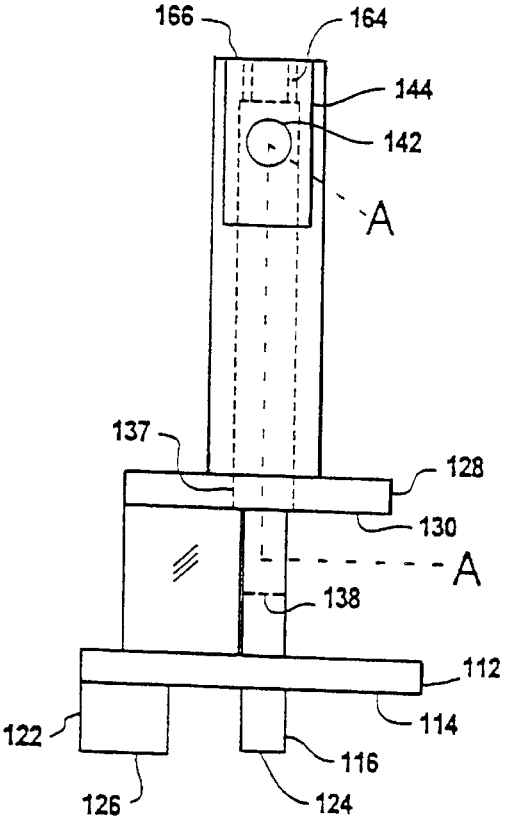
Fig. 6 PRIOR ART
FIG. 6 is a front view of a valve chamber insert of FIG. 5.
Figure 7:
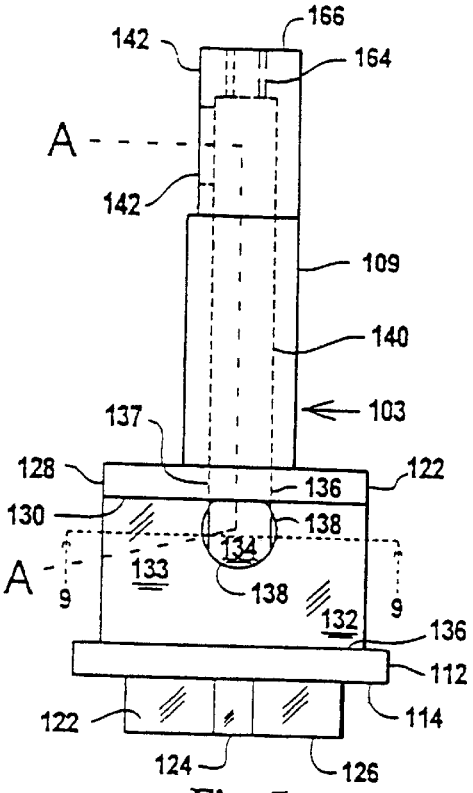
Fig. 7 PRIOR ART
FIG. 7 is side elevation of the valve chamber insert of FIG. 6.
Figure 8:
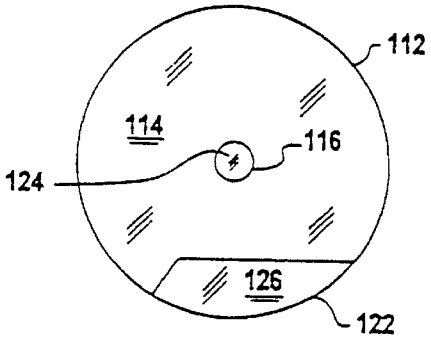
Fig. 8 PRIOR ART
FIG. 8 is a bottom view of the valve chamber insert of FIG. 7.

As shown in FIGS. 6–8, the insert 106 includes a disc 112 with a surface 114 that is integrally connected to a cylindrical capstan 116. The disc 112 and the capstan 116 are coaxial.

A coil spring 118 (FIG. 5) is wound about the capstan 116. One end of the spring 118 (not shown) is fixedly connected to the capstan 116; the other end is fixedly connected to the wall of the valve chamber 76. The purpose of the spring 118 is explained hereinafter.

The disc 112 is integrally connected to a support member 122 (FIGS. 6–8). A surface 124 (FIG. 8) of the capstan 116 and a surface 126 of the member 122 are rotatably supported upon the sheet 110 (FIG. 5). Accordingly, a rotary movement of the insert 106 causes a corresponding rotary sliding movement of the capstan 116 and the member 122 upon the sheet 110.

Figure 10:
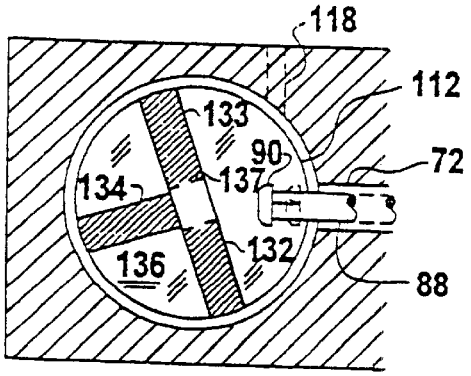
Fig. 10 PRIOR ART
FIG. 10 is a view of the valve chamber insert of FIG. 5 taken along the line 10—10.
Figure 9:
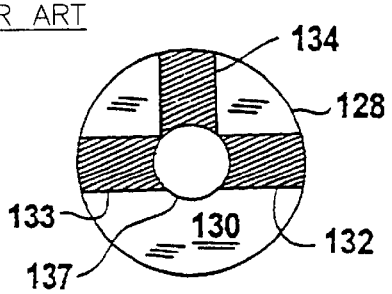
Fig. 9 PRIOR ART
FIG. 9 is a view of the valve chamber insert of FIG. 7 taken along the line 9—9.

As shown in FIGS. 9 and 10, with continuing reference to FIGS. 6 and 7, the insert 106 additionally includes a disc 128 with a surface 130 that is integrally connected to vanes 132–134 (FIG. 9) at distal ends thereof. Proximal ends of the vanes 132–134 (FIG. 10) are integrally connected to a surface 136 of the disc 112.

The insert 106 is rotatable to cause the vane 132 to move the end 90 in a direction opposite from the direction of the arrow 92, thereby clearing the passageway 72. The purpose of the vanes 133, 134 is to provide structural support for a separation that is maintained between the discs 112, 128.

It should be understood that the range of angles of rotation of the insert 106 that causes the vane 132 to clear the passageway 72 is directly related to the widths of the vane 132 and the end 90. The widths are chosen to cause the passageway 72 to be cleared when the location of the distal portion 54 is within a range substantially defined by the locations 62, 64. As explained hereinafter, the rotation of the discs 112, 128 is caused by a corresponding rotation of the handle 42.

The disc 128 has a central hole 137 there through that extends to an intersection of the vanes 132–134 (FIG. 9). Additionally, a hole 138 extends through an intersection of the vanes 132, 133 to an edge of the vane 134. There is substantially a ninety-degree angle of intersection between the holes 137, 138.

The transfer tube 108 has an axial hole 140 that is contiguous with the hole 137. The holes 137, 140 have substantially the same diameter.

Figure 11:
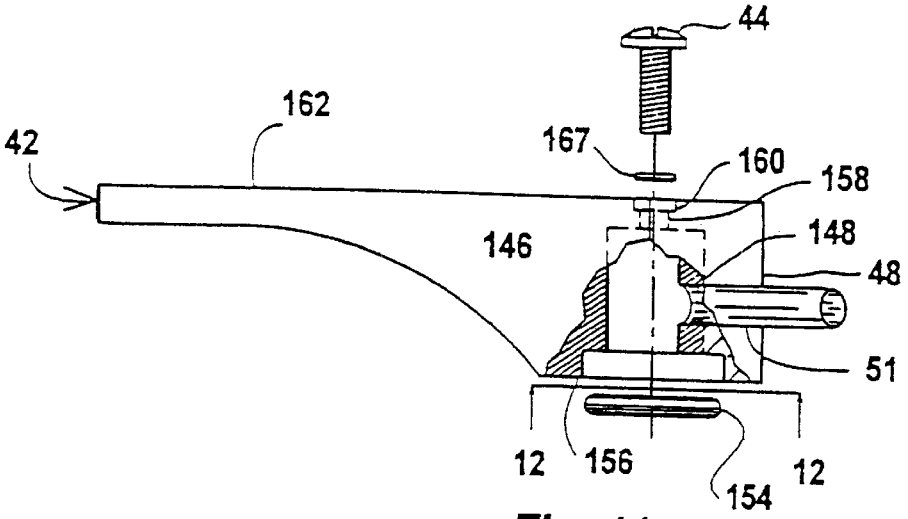
Fig. 11 PRIOR ART
FIG. 11 is a side elevation, with parts broken away, of a handle of the apparatus of FIG. 2.
Figure 12:
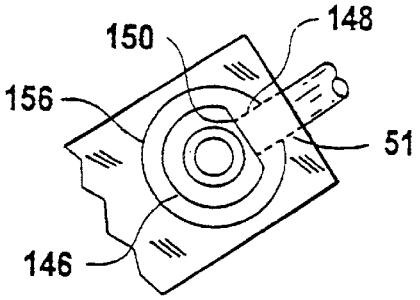
Fig. 12 PRIOR ART
FIG. 12 is a view of FIG. 11 taken along the line 12—12.

The protruding section 109 has a discharge hole 142 therein that has an angle of intersection of substantially ninety degrees with the hole 140. The protruding section 109 additionally has a flattened outer surface 144 in the region of the hole 142. Therefore, when the passageway 72 is cleared, water that enters the valve chamber 76 passes through the transfer tube 108 and is discharged therefrom through the discharge hole 142. The path of water through the discharge tube 108 is along a path A—A shown in broken lines (FIGS. 6 and 7). As explained hereinafter the flattened wall 144 is used to couple the tube 108 to the handle 42. As shown in FIGS. 11 and 12, the handle 42 has a generally cylindrical coupling hole 146 therein that has substantially the same diameter as the transfer tube 108 (FIGS. 6 and 7).

An outlet hole 148 extends through the end 48 and has an angle of intersection of substantially ninety degrees with the coupling hole 146. The proximal end 51 is disposed within the hole 148 and is preferably cemented therein whereby the tube 50 extends from the end 48 as described hereinbefore.

The coupling hole 146 has a flattened surface 150 in the region of the intersection with the hole 148. In this embodiment, the shape of the coupling hole 146 is complimentary to the shape of the protruding section 109.

The protruding section 109 is disposed within the coupling hole 146 with the flattened surfaces 144, 150 in an abutting relationship. The complimentary shapes prevent a rotation of the handle 42 relative to the transfer tube 108. In other words, when the handle 42 is rotated, the insert 106 is rotated. Hence, the handle 42 is rotatable to cause either the occlusion or the clearing of the passageway 72. Moreover, the occlusion occurs when handle 42 is rotated to cause the tube 50 to be in the rest position.

The holes 142, 148 are in an alignment that is maintained by the complimentary shapes. The alignment is essential to providing a desired transfer of water through the transfer tube 108 to the tube 50 through the handle 42.

The spring 118 urges the transfer tube 108 to rotate in a direction that results in the occlusion the passageway 72. Because the relative rotation is prevented, the handle 42 is urged to rotate in a direction that moves the tube 50 to the rest position. Therefore, when the woman releases the handle 42, the tube 50 is rotated to the rest position and no water flows there through, whereby the toilet can be used for usual toilet facility activities.

Preferably, an O-ring 152 (FIG. 5) is maintained about the transfer tube 108 to prevent a leakage of water from the valve block 40 between the transfer tube 108 and the hole 94. Similarly, an O-ring 154 (FIG. 11) is preferably retained within a recess 156 within the handle 42 to prevent a leakage of water from the coupling hole 146.

The coupling hole 146 is contiguous with a cylindrical coupling section 158 within the handle 42. The coupling section 158 is contiguous with an O-ring recess 160 that extends through a top surface 162 of the handle 42. Additionally, the hole 140 is contiguous with a threaded hole 164 (FIGS. 6 and 7) that extends through a top 166 of the protruding section 109.

When the protruding section 109 is within the coupling hole 146, the screw 44 is screwed into the hole 164, thereby securely connecting the handle 42 to the transfer tube 108. Additionally, an O-ring 167 is disposed within the recess 160 to prevent a leakage of water from the coupling hole 146. O-rings are well known in the art.

The hose bib 46 is connected at its scalloped end 70 (FIG. 1) to a water heater 168 at an outlet end 170 thereof through a flexible tube 172. An inlet end 174 of the heater 168 is connected through a TEE connector 176 and a flexible tube 178 to a manual control valve 180 at an outlet port 182 thereof whereby water from the port 182 is available to the hose bib 46 via the heater 168.

The heater 168 has a manual control knob 184 that is adjustable to cause water provided at the outlet end 170 to be at a desired temperature. The heater 168 is of a type well known in the art.

Preferably, the heater 168 includes a compartment where medication may be placed for a timed release into the water provided at the outlet end 170 whereby a medicated solution is provided at the outlet end 170. The medicated solution may be desirable when a woman who has had an episiotomy uses the apparatus 10. Apparatus for providing the timed release of the medication is well known to those skilled in the art.

The tee connector 176 is additionally connected to a toilet water tank 186 at an input port 188 whereby water is available within the tank 186 to flush the bowl 18. Toilet water tanks are well known to those skilled in the art.

2. The Present Invention

Figure 13:
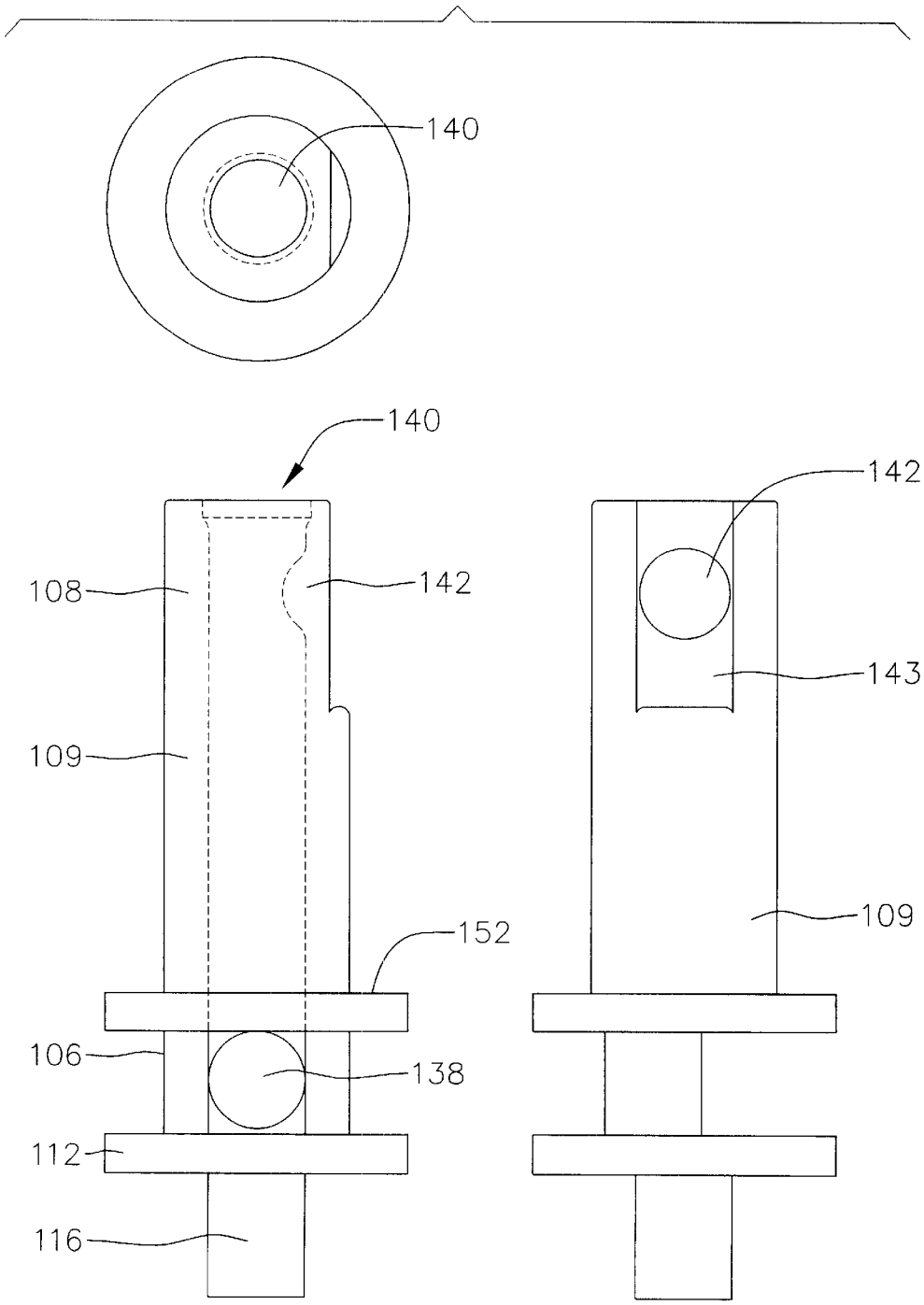
FIG. 13 shows various orthogonal views of the transfer tube according to the present invention.

Turning to FIG. 13, the transfer tube 108' of the present invention is shown. The transfer tube 108' is substantially similar to the tube 108 including an upstanding section 109, capstan 116, discharge hole 142 fashioned in a flat 143 and which communicates with an axial hole 140. The axial hole 140, in turn, is in communication with the water flow passageway 72 through hole 138. The axial hole 140, proximate the end of the section 109 opposite the capstan 116 is threaded to receive the screw 44' of the present invention. Further the flat 143 extends to the end of the section for purposes of which will hereinafter become evident. The tube 108' may be fashioned from a suitable plastic.

To rotate the transfer tube 108' the handle 42' of the present invention is provided. The handle 42' may be ergonomically designed and includes a head 99 with a hole 100' there through which is configured to pass and mate with the top of the transfer tube 108' as well as accommodate the end 51 of the water tube 50 as in FIG. 11. The hole 100' has a stepped countersink 101 to receive the screw 44' head 51.

To secure the handle 42' to the transfer tube 108', the screw 44' is provided. Unlike the screw 44 of my prior patent, screw 44' has a threaded shank 45 with an axial bore 47 which emerges from a side of the shank 45 to define a port 49. The shank 45 is threaded and sized to be closely received and threaded into the threaded end of the transfer tube 108'. Rotation of the screw 44' opens and closes the hole 142 by registering all or a portion of the port 49 with the hole 142 to control the pressure/flow of he water through the transfer tube 108' to the water tube 50. The screw 44' also mounts the handle 42' to the transfer tube 108'. Manipulation of the handle 42' swings the tube 50 into position for the water flowing there through and though the port 49 of the screw 42' to flow through the holes 58. Thus it can be appreciated that the handle 42' swings the tube 50 and registers the hole 158 with the passageway 72 to pass the water through hole 140 and port 49 out through the tube 50. The flow and pressure of the water is controlled by the port 49 which can open and close the hole 142 and modulate the flow of the water to the tube 50 and holes 58.

Figure 15:
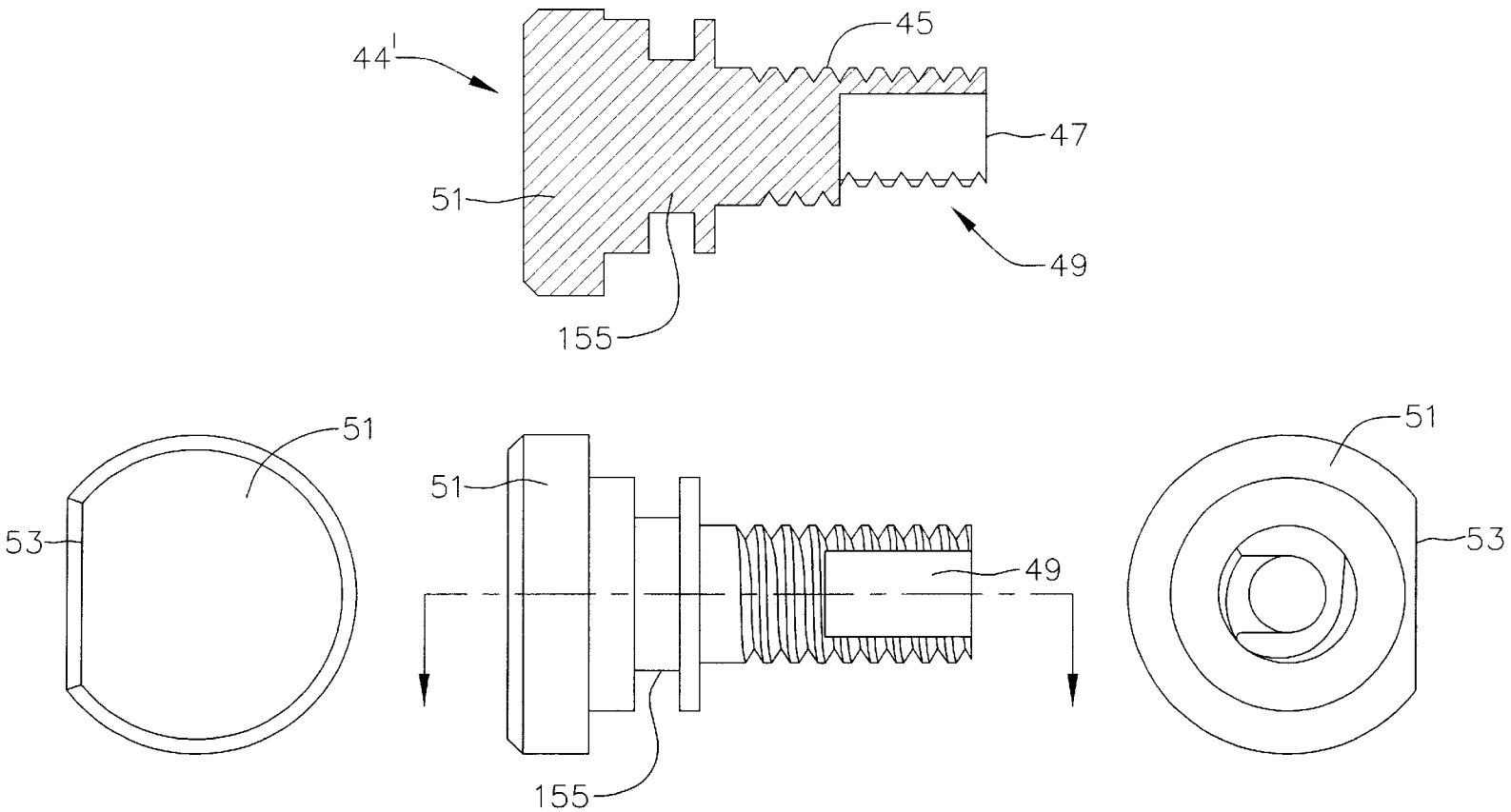
FIG. 15 shows various orthogonal and section views of the flow control and shut-off screw according to the present invention.

With reference to FIG. 15, he screw 44' may be provided with a recessed shoulder 155 to retain a sealing elastomeric washer (not shown). The head 51 also includes a flat 53.

To couple the handle 42' to the transfer tube 108' the handle 42' hole 100' includes a flat (not shown) to mate with the flat 143 of the transfer tube 108'.

Figure 14:
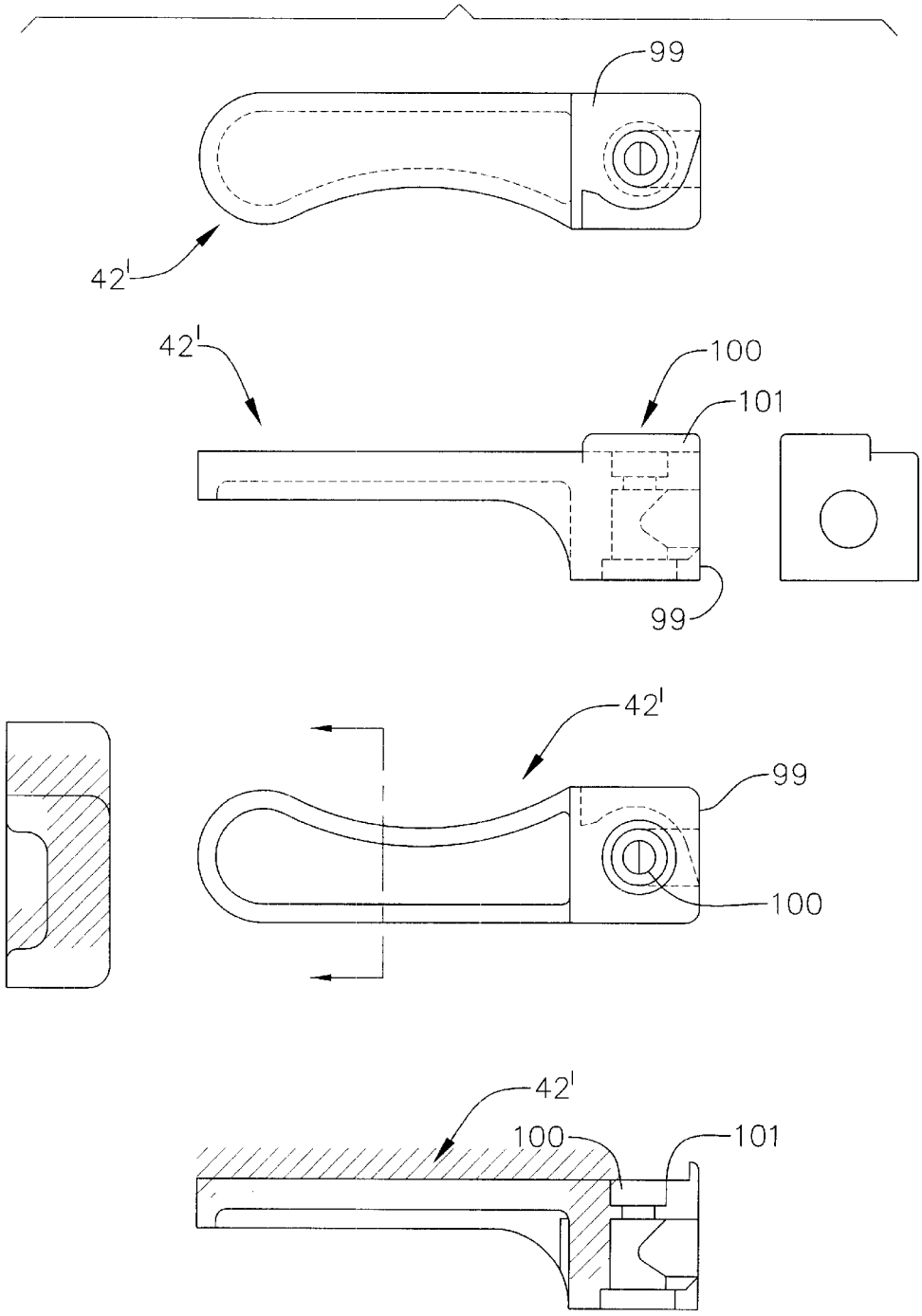
FIG. 14 shows orthogonal and section views of the handle according to the present invention.
Figure 16:
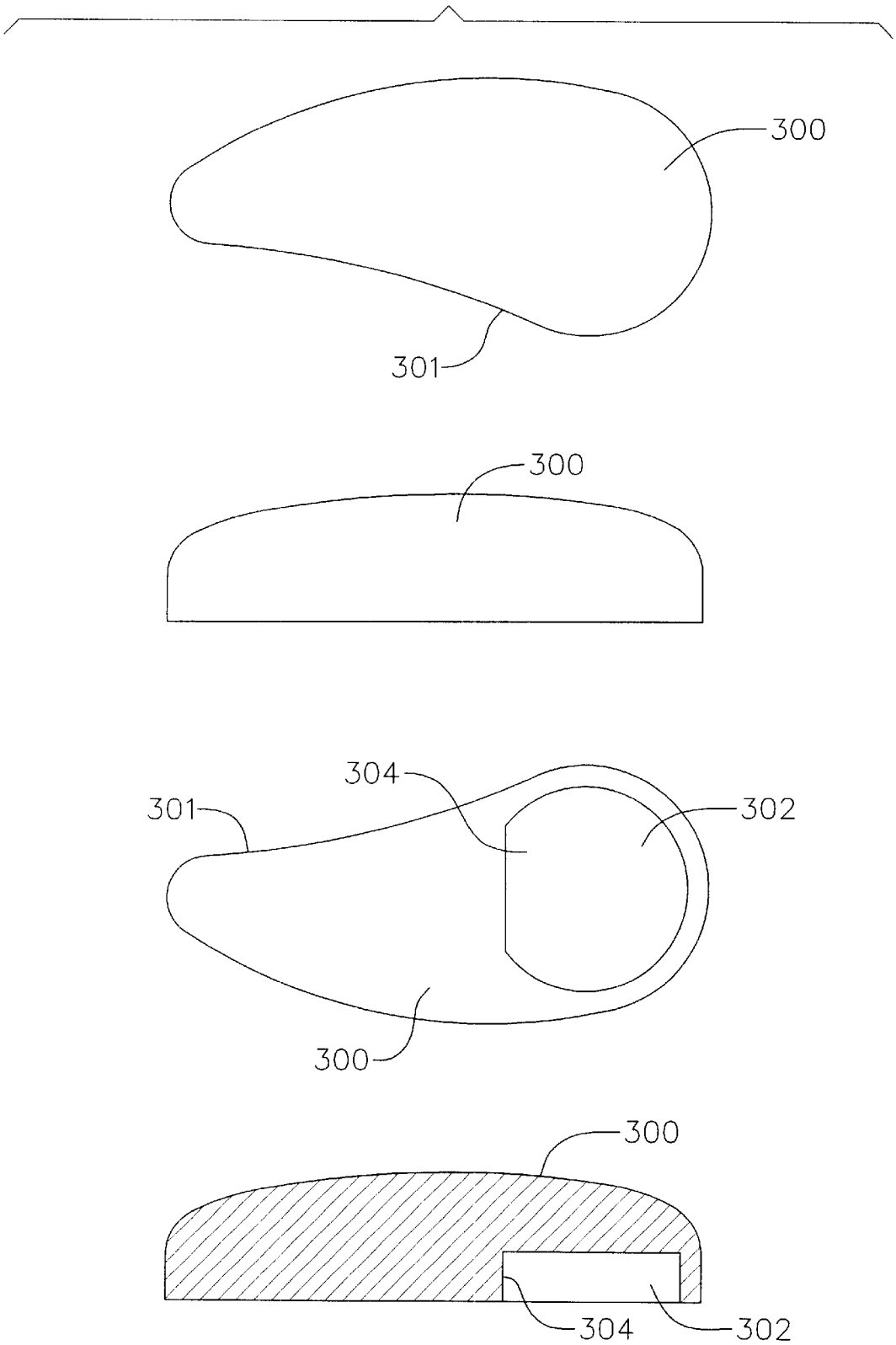
FIG. 16 shows orthogonal views of the flow control actuator.

To provide an ergonometric actuator for the flow control, the device of the present invention includes a flow control actuator 300 as shown in FIG. 16. The actuator 300 may be of any suitable shape such as a tear drop shape as shown which defines arcuate surface 301 to be engaged by the thumb or finger for rotation of the actuator 300. At the underside of the actuator 300 is a cylindrical recess 302 having a flat 304 to closely receive and mate with the head 51 of the screw 44'. The actuator 300 is secured to the screw 44' head 51 by a suitable adhesive. The actuator 300 when mounted to the screw 44' head 51 is disposed on top of the top surface of the handle 42' with the actuator poised for control by a finger or the thumb. In a first position, the actuator 300 is disposed to permit the water to flow through the tube 52 at full water line pressure when the handle 42' is manipulated. At this position the actuator 300 engages a stop 306 on the handle 42' (FIG. 14) to prevent over rotation of the actuator 300. At a second position, the actuator is rotated approximately 180 degrees to engage the stop 306 on the handle 42' to shut off water flow, regardless of the position of the handle 42' and preventing over-rotation of the actuator 300. The actuator 300 can also be position anywhere between the first and second positions to modulate the flow of water. Thus the user can modulate flow when the handle 42' is in the "On" position to control flow and pressure of the water or can be preset to the desired modulated position and left in that position for the comfort of the user. The actuator 300 can be placed in the second position to prevent flow regardless of the position of the handle 42'.

While I have shown certain embodiments of the present invention it is to be understood that it is subject to modifications and changes without departing from the spirit and scope of the invention.

I claim:

1. An improved bidet device of the type having a frame to mount the device between the toilet bowl and seat, a handle mounting a water tube that passes over the rim of the bowl to the interior thereof, said handle mounted to the frame for rotation of the tube from a rest position to positions for spraying the underside of a torso of a person seated on the bowl, said tube including spray holes, a supply of water for supplying water to the tube for spraying of the torso through the holes and a valve for opening the supply of water to the tube as the handle and tube are rotated from the rest position and closing the supply when the handle is returned to the rest position, said improvement comprising:

said handle including a hollow capstan rotatable therewith, said capstan having at one end a first hole adapted to communicate with the supply of water and at the other end a second radial hole adapted to communicate with the tube, said capstan including at the second end internal threads;

a screw having a hollow shank with external threads to be threadably received into and close said capstan second end and to couple the handle to the capstan for rotation of the capstan with the handle to rotate the tube and open and close the supply of water through the capstan and tube, said shank further including a radial port to rotatably register with the capstan second hole; and an actuator coupled to the screw to rotate the screw relative to the handle to position the port between a closed position where the port is positioned to not register with the second hole to prevent the flow of water to a full open position where port is fully registered with the second hole for full flow of water through the tube to modulate the flow and pressure of water though the tube and spray holes.

2. The improved bidet device of claim 1 wherein said screw has a head and said actuator has a recess keyed for coupling thereof.

3. The improved bidet device of claim 1 wherein the actuator is ergonometrically shaped having a tear drop shaped plan to define an arcuate surface to mate with the thumb for actuation of the actuator apart from actuation of the handle.

* * * * *